United States Patent [19]

Garlichs

[11] Patent Number: 4,767,250

[45] Date of Patent: Aug. 30, 1988

[54] SYSTEM ON A BOOKBINDING MACHINE, TO PERMIT ACTUATOR-EFFECTED POSITIONING OF MACHINE ELEMENTS FOR BOOK BLOCK FORMAT CHANGING

[75] Inventor: Siemen Garlichs, Espelkamp, Fed. Rep. of Germany

[73] Assignee: Kolbus GmbH & Co. KG, Rahden, Fed. Rep. of Germany

[21] Appl. No.: 37,337

[22] Filed: Apr. 13, 1987

[30] Foreign Application Priority Data

Apr. 18, 1986 [DE] Fed. Rep. of Germany ..... 3613120

[51] Int. Cl.[4] ..... B42C 13/00; B42C 13/04; B65H 43/02; B21J 15/28

[52] U.S. Cl. ..... 412/11; 412/13; 227/1; 270/56

[58] Field of Search ..... 412/11, 12, 13, 14, 412/9, 10; 270/37, 56, 57; 227/1, 2, 3

[56] References Cited

U.S. PATENT DOCUMENTS

| | | | |
|---|---|---|---|
| 3,627,303 | 12/1971 | Zeewy | 270/56 |
| 3,928,119 | 12/1975 | Sarring | 412/11 |
| 3,953,277 | 4/1976 | Kuhns | 412/11 |
| 4,078,784 | 3/1978 | Mikskoff et al. | 270/56 |
| 4,621,757 | 11/1986 | Osako | 227/1 |
| 4,634,107 | 1/1987 | Vandersyde et al. | 270/56 |

*Primary Examiner*—E. R. Kazenske
*Assistant Examiner*—Paul M. Heyrana, Sr.
*Attorney, Agent, or Firm*—Chilton, Alix & Van Kirk

[57] ABSTRACT

An external electronic measuring apparatus 2 in which a sample book block 1 is clamped and the thickness is then determined as a displacement-dependent actual value. The apparatus further includes a microprocessor 20 in which the actual displacement value is evaluated, and is stored as a required value, and a control unit 19 for transmitting the required value to the actuators 44, 45, as an actuating variable. The measuring apparatus possesses a clamping device 8, 9 which can be driven by a motor, and which enables two or more actual displacement values to be determined, these values being functions of differing compressive forces which serve to hold the book blocks in the bookbinding machine 42. These actual displacement values are defined by switch arrangements 20, 38, 13, and 39, as pressure points P1, P2 . . . Pn, and are determined, as actual displacement values, by means of a displacement measuring facility 31-35, in a sequentially controlled procedure. The displacement values are commensurate with the exceedance of a predetermined, required compressive force, defined by a first spring means 14, and the exceedance of a predetermined, required force, defined by a second spring means 17.

20 Claims, 2 Drawing Sheets

SYSTEM ON A BOOKBINDING MACHINE, TO PERMIT ACTUATOR-EFFECTED POSITIONING OF MACHINE ELEMENTS FOR BOOK BLOCK FORMAT CHANGING

BACKGROUND OF THE INVENTION

The invention relates to a system on a bookbinding machine, for permitting actuator-effected positioning of machine elements for book block format changing, or for format changing when processing other products of a similar nature.

In the pursuit of production efficiencies in bookbinding operations, particular significance has recently been attached to shortening setting and change-over times. In cases involving such complicated machinery as bookbinding machines, book block format changes call for the expenditure of comparatively large amounts of time, especially if measured in terms of production time. Adjusting systems have already come into use in various industries which function in a purely numerical manner. A particular problem arising in the case of bookbinding machines, however, is the further need to determine numerous setting points which are effected by compression of the book block.

In a known measuring system, a sample book block is placed in a measuring station in order to determine both the distance between the transport chains and the compressive force needed to hold the book block between them, this measuring station being located at some distance from the machine elements that are to be positioned. Thereafter, the sample book block is fed to a further measuring station, where the distance between the press plates belonging to the rounding and backing press station is determined, as well as the compressive force needed to hold the book block, this force having to exceed the one exerted between the transport chains, as is well known. With this known system, the machine operator determines the compressive force appropriate in each particular case, as a measured value which is a function of both displacement and pressure—doing so purely manually and without any precise advance information—and this measured value is input to a microprocessor in which it is evaluated as an actual displacement value, and stored as a required value.

Apart from the fact that skilled, experienced operators, and only such, are required for performing the determination of the measured value, this procedure invariably necessitates a readjustment operation. Owing to the fact that it has two separate measuring stations, the known measuring system is relatively expensive to build and, regarded as a whole, is exceptionally time-consuming to operate, since this has to be done manually and at the same time involves an unavoidable readjustment operation.

SUMMARY OF THE INVENTION

The object of the present invention is to provide a system for a bookbinding machine, that determines the displacement-dependent and pressure-dependent measured values by automatic means, and in accordance with precisely-defined advance information.

The systems of the known type described above, are improved in accordance with the invention by means of an arrangement wherein the measuring apparatus possesses a clamping device which can be driven by a motor, and which enables two or more actual displacement values to be determined. These displacement values are functions of differing compressive forces which serve to hold the book blocks in the bookbinding machine. These displacement values are defined by switch arrangements, as pressure points, and are determined, as actual displacement values, by means of a displacement-measuring facility, in a sequentially controlled procedure. The desired displacement values correspond to the displacements required to overcome or exceed a predetermined, required compressive force, defined by a first force generating means, to overcome or exceed a predetermined, required compressive force, defined by a second force generating means, and to exceed such further predetermined, required compressive forces, defined by such further force generating means as may be appropriate.

The measuring system according to the invention enables all the setting values needed for the displacement-dependent and pressure-dependent format change operation to be determine without human intervention, within an extremely short space of time, and without any need for readjustment. The measured values can be determined by inexperienced operators, who may be deficient in mechanical knowledge.

BRIEF DESCRIPTION OF THE DRAWINGS

An illustrative embodiment of the invention is presented in the drawings, and is explained in greater detail in the description which follows. In the drawings.

DESCRIPTION OF THE PREFERRED EMBODIMENT

The measuring apparatus according to the invention serves to position machine elements in a bookbinding machine, in order to change over from one book block thickness to another. In the present illustrative embodiment, the measuring apparatus comes into use for setting the distances between the transport chains in the feed zone of the bookbinding machine, and between the press beams in the rounding and backing press station, these being the distances required in order to achieve clamping in each of these sections of the machine.

Figure 1:
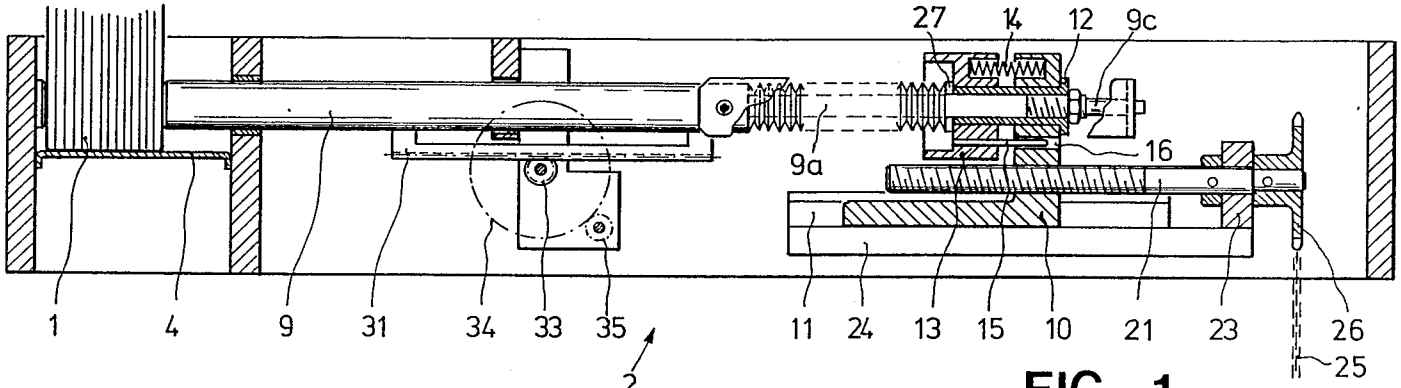
FIG. 1 shows measuring apparatus, viewed from one side.
Figure 2:
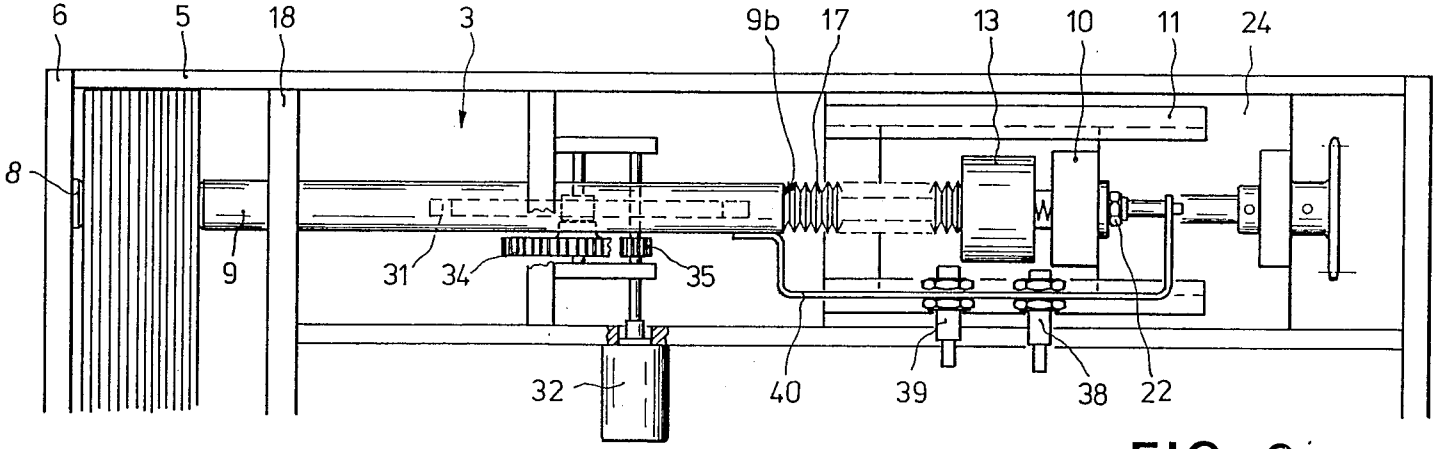
FIG. 2 shows the measuring apparatus in plain view.
Figure 3:
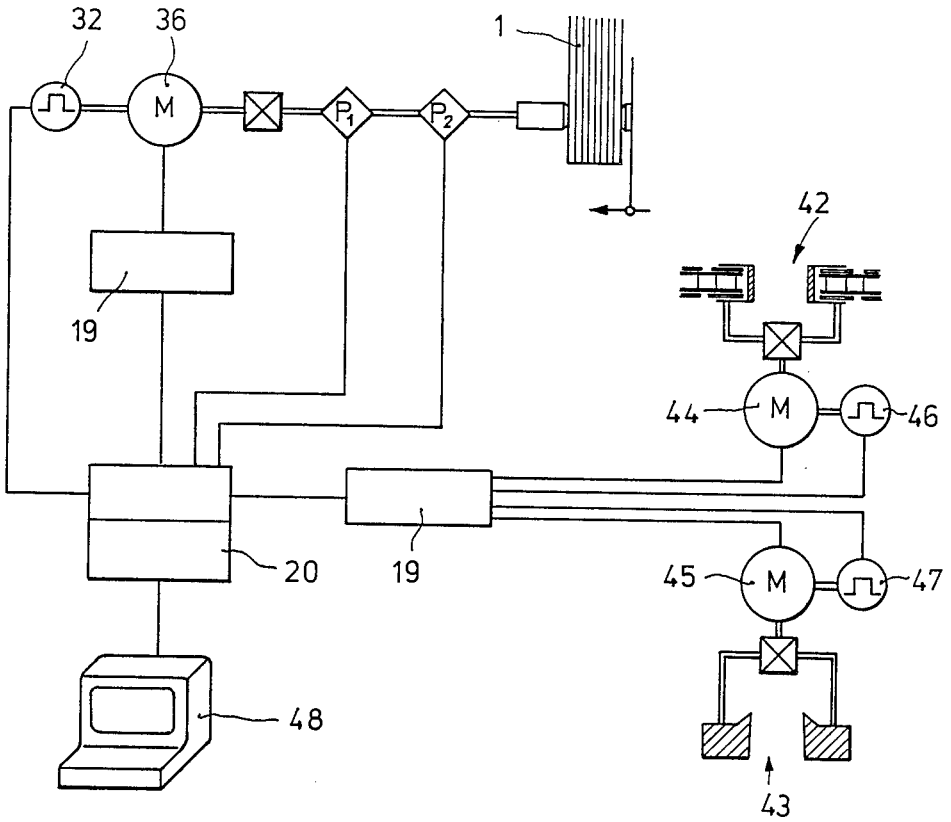
FIG. 3 shows a block circuit diagram of the control installation for the measuring apparatus.

With reference to FIGS. 1–3, the measuring apparatus 2 is installed outside the bookbinding machine, and has a frame 3, with a measuring station for receiving a sample book block 1, which is placed, spine downwards, on a bottom plate 4, and is brought into a position such that its top or bottom side, as the case may be, bears against a rear check plate 5. For performing the measurement of the thickness of the book block 1 in the near-spine side region, a fixed stop pad 8 is provided on a side plate 6 belonging to the frame 3, and a moveable measuring plunger 9 is provided opposite the fixed stop pad 8, this plunger 9 being slidably mounted in an intermediate plate 18.

On the side facing away from the measuring station, the measuring plunger 9 is supported by a slider 10, which can be slid along a guideway 11 belonging to the frame 3, and in which a reduced-diameter portion 9*a* of the measuring plunger 9 can move freely in the axial direction, within a bearing sleeve 12 that is inset in the slider 10.

A thrust ring 13 is mounted in front of the slider 10, and is likewise positioned, on the bearing sleeve 12, in a manner such that it can slide freely in the axial direction, while being spaced clear of the slider 10 by means of a diametrically-located compression spring 14. A pin 15, engaging a through-hole 16 in the slider 10, prevents the thrust ring 13 from twisting relative to the latter.

At the same time, the compression spring 14 has the function of pressing the measuring plunger 9 against the near-spine region of a clamped sample block 1, with a defined spring force that corresponds to the holding force exerted between the transport chains. This compressive force results from the preloading of the spring 14, which is clamped between the slider 10 and the thrust ring 13, and from the spring deflection.

A stack 17 of disk springs is located on the reduced-diameter portion **9*a* of the measuring plunger 9, between a thrust washer 27, located in a machined-out recess 13*a* in the thrust ring 13, and a bearing surface 9*b* that is formed on the measuring plunger 9 as a result of the production of its reduced-diameter portion 9*a***.

The disk-spring stack 17 presses the measuring plunger 9 against the near-spine region of the book block 1, with a second defined spring force, corresponding to the holding force exerted between the press beams in the rounding and backing press station.

The disk-spring stack 17 is held under preload by means of a nut 22 which fits onto a threaded portion **9*c* of the measuring plunger 9. Forward movement of the measuring plunger 9 is accompanied by compression of the disk-spring stack, and the measuring plunger 9 in fact comes to bear against the book block, with a compressive force that exceeds the one that the spring 14** is exerting on it.

The forward and backward movements of the slider 10, on the slideway 11 of the frame 3, are brought about by means of a threaded spindle 21 which engages into a threaded portion of the slider 10. The threaded spindle 21 is mounted in a bearing block 23, in a manner permitting free rotation, this bearing block 23 being fastened to a baseplate 24 belonging to the frame 3, in the same way as the guideway 11. The rotary drive for the spindle 21 originates from a drive unit such as motor 36, FIG. 3, and is transmitted via the chain 2 that is indicated in FIG. 1, and via a chainwheel 26.

In order to determine the actual displacement values which result once the two defined, required compressive forces have been exceeded, and to transmit them to a rotation-signal transmitter 32 that is assigned to the measuring apparatus, a toothed rack 31 is located on the measuring plunger 9. This rack 31 meshes with a gearwheel 33 in order to convert the straight-line measurement steps into angular ones, the forward movement of the measuring plunger 9 being transmitted from the gearwheel 33 to the rotation-signal transmitter 32 via gearwheels 34, 35. Electrical signals are generated as a function of the instantaneous position of the rotation-signal transmitter, and are input to a microprocessor 20, FIG. 3.

As can be appreciated from the block circuit diagram shown in FIG. 3, the actual displacement values arrive at the microprocessor 20 as electrical signals from the rotation-signal transmitter 32, are evaluated in the microprocessor 20, as input data, and are stored as required-value quantities. The values are also displayed on a monitor 48.

In order to effect re-positioning when the spacing on transport chains 42 and press plates 43 have to be reset during a format change, the stored, required-value quantities are recalled, and are supplied, via a microelectronic control unit 19, to the rotation-signal transmitters 46, 47 which are assigned to the machine elements, and in which the electrical signals are converted into actuating variables that are used, with the initial values, to adjust the clamping spacing set points for the machine elements with the aid of appropriate actuators 44, 45.

The following paragraphs are intended to provide a description of the mode of operation of the measuring apparatus according to the invention.

In order to set the spacing between the transport chains 42 and between the press beams 43, in which the book blocks have to be clamped by compressive forces which differ as a function of format, a sample book block 1 is brought into snug contact with the measuring station of the measuring apparatus 2. As a result of pressing a switch-on button on the control unit 19, the measuring plunger 9 departs from a reference zero position, and moves into contact with the near-spine side region of the book block 1. Once a defined compressive force P1, predetermined by the compression spring 14, has been exceeded, a first position of the measuring plunger 9, reached from the starting point represented by its zero position, is determined by a proximity switch 38 which is installed on a bridge 40 belonging to the measuring plunger 9, and which enters into interactive coupling with the slider 10. This first position is input to the microprocessor 20 via the rotation-signal transmitter 32, as a displacement-dependent and pressure-dependent measured value representing the holding force which should be exerted between the transport chains 42, namely a measured value that will be used for determining a required value.

On advancing further, the measuring plunger 9 overcomes a higher compressive force P2, predetermined by the disk-spring stack 17, and a second position, reached by the measuring plunger 9, is determined by a proximity switch 39 which is likewise installed on the bridge 40 belonging to the measuring plunger 9, and which enters into interactive coupling with the thrust ring. This second position is supplied to the microprocessor 20 via the rotation-signal transmitter 32, as a displacement-dependent and pressure-dependent measured value representing the holding force which should be exerted between the press beams 43, namely a measured value that will be used for generating a required value.

The pressure-dependent actual displacement values that have been determined from a sample block 1 are consequently available as stored required values, ready to be recalled for any subsequent repositioning of the transport chains and press beams, which would be effected automatically.

Once the second measurement position has been reached, the forward movement of the measuring plunger 9 is automatically switched off, and the plunger returns to its starting position.

The invention is not restricted to the illustrative embodiment that has been presented and described, and lends itself, for example, to multiplication in order to perform any desired number of displacement-dependent and pressure-dependent measurements.

I claim:

1. Apparatus for generating signals commensurate with multiple processing parameters of a compressible solid product comprising:

adjustable clamp means for receiving and supporting a sample of the compressible product to be processed;

means for generating a first predetermined force;

means for generating a second predetermined force;

means for adjusting said clamp means by displacing at least a portion thereof, to apply an increasing compressive force against the sample;

means coupled to said means for adjusting, for sensing the displacement of said portion relative to a reference point and for generating a displacement signal commensurate therewith, said displacement corresponding to the magnitude of the compressive force applied by said clamp means against the sample;

means for sensing when an increasing compressive force applied by said clamp means exceeds said first predetermined force and for generating a first control signal commensurate therewith;

means for sensing when an increasing compressive force applied by said clamp means exceeds said second predetermined force and for generating a second control signal commensurate therewith; and means responsive to said first and said second control signals and to said displacement signal for generating processing parameter command signals.

2. The apparatus of claim 1 wherein the product is a book block and wherein said clamp means has a stationary jaw and an oppositely disposed moveable plunger, the book block being positioned between said jaw and plunger, and wherein the processing parameters include required set point values for the displacements between pairs of cooperating bookbinding machine elements.

3. The apparatus of claim 2 wherein said means for generating first and second predetermined forces comprise first and second spring means respectively.

4. The apparatus of claim 2 further comprising means for coupling said means for adjusting to said plunger through said means for generating first and second predetermined forces.

5. The apparatus of claim 3 further comprising means for coupling said means for adjusting to said plunger through said first and second spring means.

6. The apparatus of claim 5 wherein said first and second spring means are connected in series.

7. The apparatus of claim 6, wherein said means for adjusting comprises;

linearly movable slider means, said slider means supporting said first spring means:

drive means connected to said slider means for selectively linearly driving said slider means toward and away from said book block;

thrust ring means, said thrust ring means being supported for linear movement relative to said slider means and being coupled to said slider means by said first spring means, said thrust ring means being coupled to said second spring means whereby said second spring means biases said thrust ring means toward said slider means;

whereby operation of said drive means in a first direction imparts linear movement to said slider means, said slider means movement being imparted to said plunger through said first spring means, said thrust ring means and said second spring means.

8. The apparatus of claim 2, further in combination with a bookbinding machine, wherein the apparatus is external to said book binding machine.

9. The combination of claim 8 wherein said means responsive to said first and second control signals and to said displacement signal includes a microprocessor electronically coupled between said apparatus and said book binding machine.

10. The combination of claim 9 wherein said first and second control signals are stored in said microprocessor as first and second of said required set point values.

11. The combination of claim 10, wherein said bookbinding machine elements include a book block transport mechanism having spaced apart holding surfaces for compressively engaging a book blank and a rounding and backing press including spaced apart press plates, and wherein the first and second set point values are determinative of the operative spacing between said holding surfaces and said press plates, respectively.

12. The apparatus of claim 11, wherein said holding surfaces and said press plates have actuators respectively associated therewith, and wherein said set point values are transmitted to said actuators for adjusting the operative spacing of the holder surfaces and the press plates.

13. The apparatus of claim 7, wherein said drive means is a motor.

14. The apparatus of claim 13, wherein the motor is operatively connected to said means responsive to said first and second control signals.

15. The apparatus of claim 3, wherein the plunger is displaced sequentially toward said book block, counter to the action of said first spring means, and subsequently counter to the action of said second spring means with a compressive force that exceeds the first predetermined force.

16. The apparatus of claim 7, wherein said means for sensing when an increasing compressive force exceeds said first predetermined force includes a proximity switch interactively coupled between said slider means and said plunger, and wherein said means for sensing when an increasing compressive force applied by said clamp exceeds said second predetermined force, includes another proximity switch interactively coupled between said plunger and said thrust ring means.

17. The combination of claim 9, wherein said means for generating first and second predetermined forces comprises first and second spring means, respectively.

18. The apparatus of claim 11, further comprising means for coupling said means for adjusting to said plunger through said means for generating first and second predetermined forces.

19. The apparatus of claim 17, further comprising means for coupling said means for adjusting to said plunger through said first and second spring means.

20. The apparatus of claim 19, wherein said means for adjusting comprises:

linearly movable slider means, said slider means supporting said first spring means;

driver means connected to said slider means for selectively linearly driving said slider means toward and away from said book block;

thrust ring means, said thrust ring means being supported for linear movement relative to said slider means and being coupled to said slider means by said first spring means, said thrust ring means being coupled to said second spring means whereby said second spring means biases said thrust ring means toward said slider means, said first and second spring means thereby being connected in series;

whereby operation of said drive means in a first direction imparts linear movement to said slider means, said slider means movement being imparted to said plunger through said first spring means, said thrust ring means and said second spring means.

* * * * *